US009635896B2

(12) United States Patent
Gaudillere

(10) Patent No.: US 9,635,896 B2
(45) Date of Patent: May 2, 2017

(54) SWIVELLING NECKBAND FOR A PROTECTION HELMET

(71) Applicant: ZEDEL, Crolles (FR)

(72) Inventor: Antonin Gaudillere, Grenoble (FR)

(73) Assignee: ZEDEL, Crolles (FR)

( * ) Notice: Subject to any disclaimer, the term of this patent is extended or adjusted under 35 U.S.C. 154(b) by 262 days.

(21) Appl. No.: 14/686,284

(22) Filed: Apr. 14, 2015

(65) Prior Publication Data

US 2015/0327617 A1 Nov. 19, 2015

(30) Foreign Application Priority Data

May 16, 2014 (FR) ..... 14 01111

(51) Int. Cl.

| | |
|---|---|
| ***A42B 3/14*** | (2006.01) |
| ***A42B 3/08*** | (2006.01) |
| ***A42B 3/06*** | (2006.01) |
| *A42B 3/00* | (2006.01) |

(52) U.S. Cl.

CPC ..... *A42B 3/085* (2013.01); *A42B 3/06* (2013.01); *A42B 3/006* (2013.01)

(58) Field of Classification Search

CPC ..... A42B 3/085; A42B 3/145; A42B 3/14

See application file for complete search history.

(56) References Cited

U.S. PATENT DOCUMENTS

| | | | | | |
|---|---|---|---|---|---|
| 3,991,422 | A * | 11/1976 | Saotome | A42B 3/322 | 2/410 |
| 4,796,308 | A * | 1/1989 | Bourgeois | A42B 3/185 | 2/10 |
| 6,854,133 | B2 * | 2/2005 | Lee | A42B 3/063 | 2/412 |
| 2002/0000004 | A1 * | 1/2002 | Wise | A42B 3/14 | 2/416 |
| 2002/0073479 | A1 * | 6/2002 | Epperson | A42B 3/12 | 2/410 |
| 2009/0320186 | A1 * | 12/2009 | Petzl | A42B 3/145 | 2/417 |
| 2011/0277222 | A1 * | 11/2011 | Garneau | A42B 3/085 | 2/421 |
| 2013/0219597 | A1 * | 8/2013 | Van Waes | A42B 3/0413 | 2/421 |
| 2015/0330425 | A1 * | 11/2015 | Gaudillere | F16B 2/06 | 2/417 |
| 2016/0192726 | A1 * | 7/2016 | Gaudillere | A42B 3/145 | 2/421 |

FOREIGN PATENT DOCUMENTS

| | | | |
|---|---|---|---|
| JP | 2006-188771 | A | 7/2006 |
| WO | 00/04800 | A1 | 2/2000 |

* cited by examiner

*Primary Examiner* — Bobby Muromoto, Jr.
(74) *Attorney, Agent, or Firm* — Oliff PLC

(57) ABSTRACT

A protection helmet includes a crown provided with a frontal part and an occipital part including an inner occipital part, a neckband having an inner surface designed to be in contact with a user's head, and articulation system configured to allow passage of the neckband from a use position to a storage position of the protection helmet. In the storage position, the neckband is folded into the occipital part of the crown so that the inner surface is facing the inner occipital part of the crown.

13 Claims, 2 Drawing Sheets

Fig. 3A
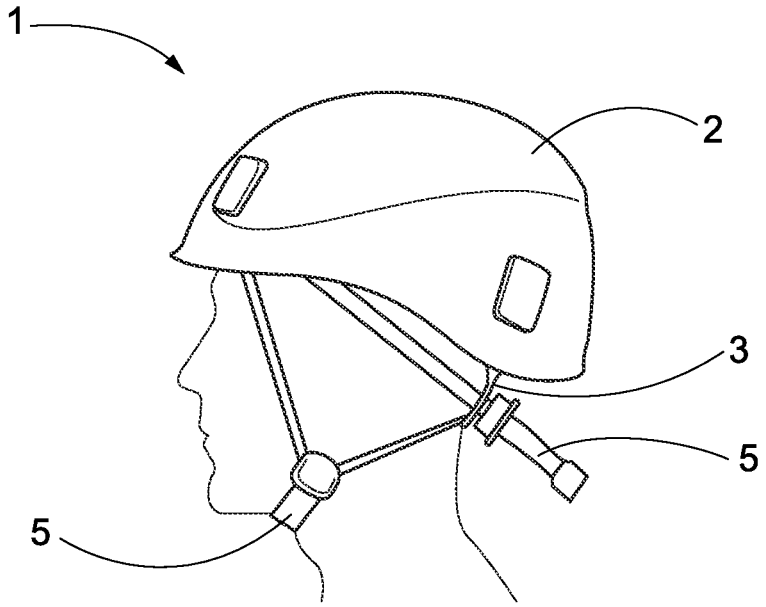
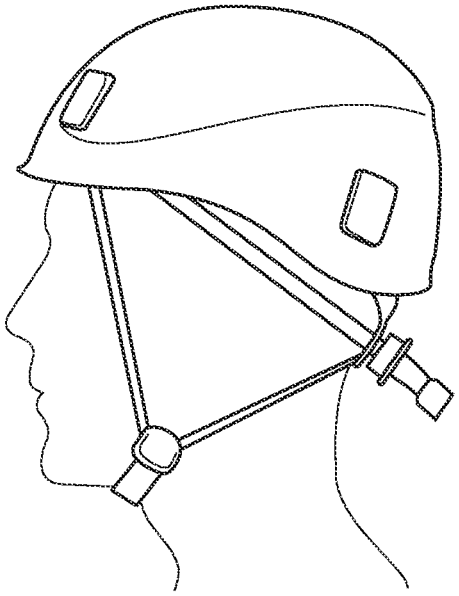
Fig. 3B

SWIVELLING NECKBAND FOR A PROTECTION HELMET

BACKGROUND OF THE INVENTION

The invention relates to a protection helmet comprising a neckband.

STATE OF THE ART

Protection helmets are for example used in mountaineering or in rock-climbing to act as protection in case of falling stones or an impact on the head. They therefore form part of the indispensable equipment for climbers and mountaineers.

As mountaineering or rock climbing equipment is cumbersome, it is advantageous for it to be stored as compactly as possible. This is particularly true for the use of protection helmets when collective bodies are involved, as the latter become difficult to transport if they are not stacked on one another.

In practice, superposition of the helmets used in collective bodies is not easy to achieve as the latter comprise neckbands, which very often protrude out beyond the crowns of the protection helmets and prevent them from being stacked correctly.

This is for example the case for the Elios helmet (first generation, fixed neckband) marketed under the Petzl trademark by the applicant. The first generation of the Elios helmet was provided with a fixed and non-adjustable neckband preventing any stacking of the helmets on top of one another. In the second generation, the Elios helmet provided with an adjustable neckband, can be stacked provided its size is reduced to the minimum.

However stacking is performed to the detriment of the adjustments made, which results either in time wasting for the instructor who has to adjust the equipment each time it is used, or in unsatisfactory use of the helmet with the likelihood of the user not being properly protected in case of an impact.

OBJECT OF THE INVENTION

One object of the invention consists in proposing a detection helmet configured to enable easy and safe storage with other protection helmets.

For this purpose, the protection helmet comprises a crown provided with a frontal part and an occipital part comprising an inner occipital part, a neckband having an inner surface designed to be in contact with a user's head, and articulation means configured to allow passage of the neckband from a use position to a storage position of the protection helmet. In the storage position, the neckband is folded into the occipital part of the crown so that the inner surface of the neckband is facing the inner occipital part of the crown.

Furthermore, the neckband can be made from a deformable material while at the same time being able to revert to its initial shape.

According to one feature of the invention, the use position and the storage position can both be stable positions of the neckband, the force to be applied to make the neckband move from one stable position to the other being able to pass via a maximum.

The protection helmet can also comprise blocking means configured to keep the neckband in the storage position.

According to one embodiment, the articulation means can be able to force the neckband to position itself in stable manner only in the use position and in the storage position of the protection helmet.

The articulation means can further comprise at least one hinge a first part of which is connected to the neckband. At least one of the hinges can comprise a second part fixed onto the crown or onto a headband, the second part being fitted in the form of a pivot-link with the first part.

When the articulation means comprise two hinges, the latter can be provided with second parts forming pivot-links with the first parts, the axes of the two pivot-links being concurrent.

According to one feature of the invention, the protection helmet comprises adjustment means of the height of the neckband salient on the outside of the crown. The helmet can also comprise adjustment means of the neckband salient on the outside of the crown so as to adjust it to the user's head size.

The adjustment means can for example comprise at least one flexible strap, or a strap and a device for performing lengthwise adjustment of the strap.

The invention also relates to a method for storing at least two protection helmets as described above, the method comprising the following steps:

- placing the neckband of at least one of the protection helmets in the storage position,
- stacking at least one of the protection helmets on at least one of the other protection helmets.

BRIEF DESCRIPTION OF THE DRAWINGS

Other advantages and features will become more clearly apparent from the following description of particular embodiments of the invention given for non-restrictive example purposes only and represented in the appended drawings, in which.

DETAILED DESCRIPTION

Figure 1:
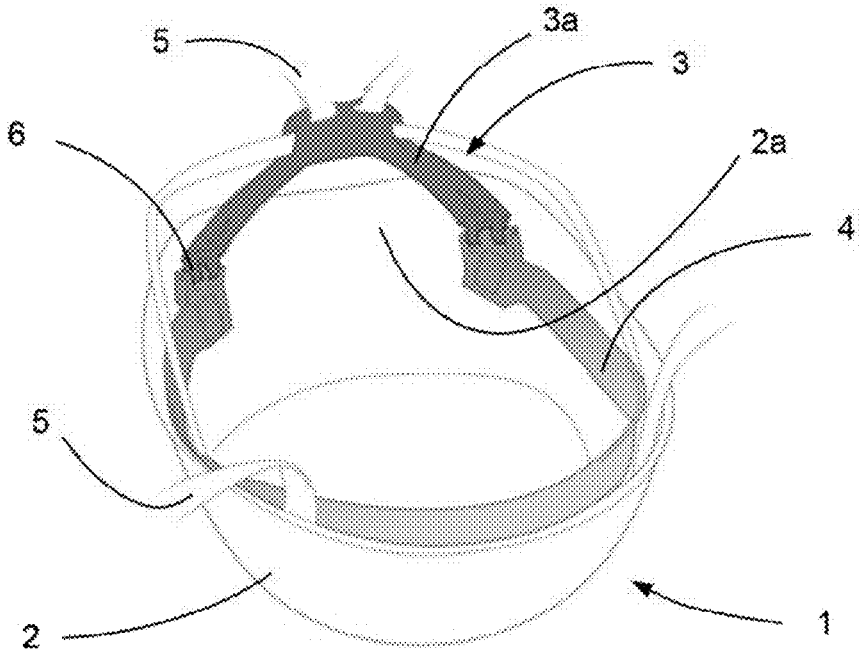
FIG. 1 represents a perspective view of an embodiment of a protection helmet comprising a neckband in the use position.
Figure 2:
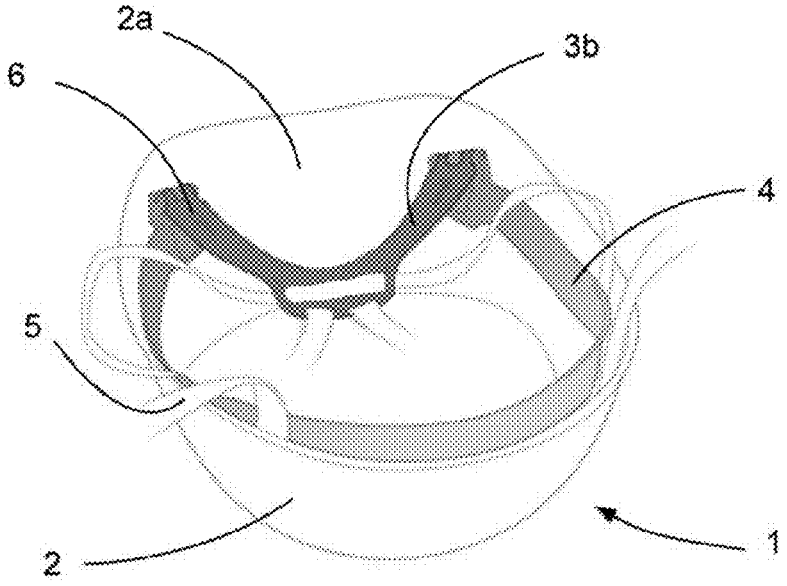
FIG. 2 illustrates the storage position of the neckband according to the embodiment of FIG. 1, FIGS. 3*a* and 3*b* represent the protection helmet positioned on the head of two different users.

FIGS. 1 and 2 represent a protection helmet 1 comprising a crown 2 made from a material preventing it from folding back onto itself. Crown 2 can be made for example from polycarbonate or injected ABS or from expanded polystyrene or polypropylene, or from any other plastic material, in particular from injected or thermoformed plastic material or from foam.

Crown 2 comprises a frontal part situated at the front, i.e. in proximity to the user's forehead, and an occipital part situated at the rear. Inner occipital part 2*a* is situated at the level of the neck when helmet 1 is in use.

Protection helmet 1 is preferably equipped with a neckband 3, advantageously made from a deformable material while being able to revert to its initial shape, such as polyamide, polyoxymethylene or polyethylene. Neckband 3 comprises an inner surface 3*a* designed to be in contact with the head of a user, and an outer surface 3*b* (cf. FIGS. 1 and 2).

Protection helmet 1 can also be equipped with a headband 4. Neckband 3 and headband 4 enable a better adjustment of the position of protection helmet 1 by pressing on the neck of a user. It is however possible to envisage that headband 4 is not present.

Protection helmet 1 is advantageously provided with chinstraps 5 enabling helmet 1 to be fixed onto a user's head. Chinstraps 5 are secured to crown 2 or to headband 4 and advantageously pass through neckband 3. The role of chinstraps 5 is to ensure contact between the neck of the user and the inner surface of neckband 3*a* when protection helmet 1 is in use.

Protection helmet 1 advantageously comprises a foam padding shell (not shown) housed inside crown 2 and directly in contact with the user's head. Crown 2 can also be provided with ventilation holes (not shown) designed to improve user comfort.

Neckband 3 is advantageously movable with respect to crown 2 and with respect to headband 4, and comprises two advantageously stable positions: a first position corresponding to a use position of the protection helmet 1 (cf. FIG. 1), and a second position corresponding to a storage position of protection helmet 1 (cf. FIG. 2).

In the first position, neckband 3 is salient outside the volume delineated by crown 2. In the second position on the other hand, neckband 3 is folded into the volume delineated by crown 2, and more precisely into the occipital part of crown 2, so that inner surface 3*a* of neckband 3 is facing inner occipital part 2*a* of crown 2.

For neckband 3 to be able to change position, protection helmet 1 is advantageously provided with articulation means 6. These articulation means 6 can advantageously comprise pivot-links such as hinges.

The hinges can be made in a single part able to fold along an axis comprising less material than the rest of the hinge, in similar manner to a valve cap.

The hinges can also be made by means of several parts connected to one another by means of a joining pin. The hinge is then similar to a door gudgeon-pin.

Articulation means 6 are designed to force neckband 3 to position itself in stable manner in the use position or in the storage position. According to a particular embodiment, these two positions can be the only two stable positions in which neckband 3 can place itself. These two stable positions are then separated by unstable positions which will place neckband 3 either in the storage position or in the use position.

Protection helmet 1 can for example comprise two articulation means 6. In the embodiment illustrated in the appended figures, articulation means 6 are advantageously hinges comprising a first part connected to the end of neckband 3, and a second part connected for example to headband 4. In an alternative manner, the hinges could comprise a second part fixed to crown 2. It is also possible to combine these two embodiments.

The first and second parts of each hinge of articulation means 6 are advantageously assembled to form a pivot-link with respect to one another.

When articulation means 6 comprise two hinges, the axes of the pivot-links are advantageously concurrent. In this way, by elastic deformation of neckband 3, the latter can move from the use position to the storage position. These two positions are then the only two stable positions of neckband 3.

Depending on the configuration used, a compressive stress or a tractive stress is applied on neckband 3 to switch from one position to the other.

To be able to switch from the first position to the second position and vice-versa, the force to be exerted passes via a maximum. The force depends mainly on the type of material used to manufacture neckband 3 and on the position of the two hinges relatively to crown 2 and/or to headband 4 depending on the place where they are attached.

Indeed, the greater the rigidity of the material of neckband 3, the more difficult it is to make it move from the first position to the second position. As far as the position of the hinges is concerned, two factors are to be taken into account: the distance separating them and the angle formed by the axes of the pivot-links. Thus, the closer the hinges are placed to one another and the smaller the angle between the axes, the more difficult it is to make neckband 3 move from one position to the other.

Neckband 3 thus comprises a sticking point which depends on the shape, the dimensions and the type of material used.

When no stable position intrinsic to neckband 3 exists, it can be envisaged to use blocking means (not shown) of neckband 3 in the storage position. The blocking means can for example be magnets, clips, hook-and-loop fasteners, etc. The blocking means can also be used as additional securing means when the storage position is a stable position of neckband 3.

As illustrated in FIGS. 3*a* and 3*b*, the shape of the head can differ depending on the age and size of the user. It may therefore further be advantageous to adjust the height of neckband 3 salient on the outside of crown 2 of protection helmet 1.

For this purpose, an advantageous embodiment of protection helmet 1 can comprise adjustment means configured to adjust the position or the size of neckband 3.

For example, neckband 3 can be formed in two parts joined to one another by adjustment means such as a rack. One of the parts comprises notches separated by a slot, whereas the other part comprises a stud designed to move inside the slot. Movement of the stud in the slot then enables the length of neckband 3 to be increased or shortened.

In alternative manner, neckband 3 can comprise two parts connected by a flexible strap. For this, one of the parts has a flexible strap terminated by a stud at one end, and the other strand has a series of holes inside which the stud can be inserted.

In these two alternative embodiments, the two parts of neckband 3 overlap more or less, but they are never far apart, otherwise the efficiency of protection helmet 1 in case of an impact would be reduced.

According to an alternative embodiment, neckband 3 can be formed by a single part connected to the two ends of headband 4, at least one of the two ends of headband 4 being provided with the adjustment means. The adjustment means are then configured to make at least one of the ends of neckband 3 slide inside protection helmet 1, so that the portion of neckband 3 that is salient is less high. In this case, at least one of articulation means 6 can be positioned on neckband 3.

In protection helmets of the prior art, neckband 3 is an impediment to correct stacking of protection helmets 1 when neckband 3 is kept in a given position. To stack protection helmets 1, the global diameter of neckband 3 has to be increased to the maximum and the adjustments made by the users therefore have to be undone. Furthermore this stacking is less stable and may damage neckband 3.

Here it is not necessary to undo the adjustments made during use to be able to store helmets 1 without any risk of damage. Neckband 3 simply has to be moved from the use position to the storage position by means of articulation means 6.

When individual use of the helmet is involved, the user is sure of the qualities of his/her protection helmet 1 and no longer has to adjust it each time it is used again.

For use in a collective body, the instructor can make the adjustments of protection helmets 1 once and for all to make the users position neckband 3 correctly. He can also stack the helmets very easily by placing each neckband 3 in the storage position.

The invention is not limited to the features which have just been mentioned. The person skilled in the art can, without departing from the scope of the invention, adjust the position and the number of articulation means 6 to suit his/her requirements.

The invention claimed is:

1. A protection helmet comprising a crown provided with a frontal part and an occipital part comprising an inner occipital part, a neckband having an inner surface designed to be in contact with a user's head, and articulation means configured to allow passage of the neckband from a use position to a storage position of the protection helmet, wherein in the storage position, the neckband is folded into the occipital part of the crown so that the inner surface of the neckband is facing the inner occipital part of the crown.

2. The protection helmet according to claim 1, wherein the neckband is deformable while at the same time being able to revert to its initial shape.

3. The protection helmet according to claim 1, wherein the use position and the storage position are both stable positions of the neckband, and wherein the force to be applied to make the neckband move from one stable position to the other passes via a maximum.

4. The protection helmet according to claim 1, comprising blocking means configured to keep the neckband in the storage position.

5. The protection helmet according to claim 1, wherein the articulation means are able to force the neckband to position itself in stable manner only in the use position or in the storage position.

6. The protection helmet according to claim 1, wherein the articulation means comprise at least one hinge a first part of which is connected to the neckband.

7. The protection helmet according to claim 6, wherein at least one of the hinges comprises a second part fixed onto the crown or onto a headband, the second part being fitted in the form of a pivot-link with the first part.

8. The protection helmet according to claim 6, wherein the articulation means comprise two hinges provided with second parts forming pivot-links with the first parts, the axes of the two pivot-links being concurrent.

9. The protection helmet according to claim 1, comprising adjustment means of the height of the neckband salient on the outside of the crown.

10. The protection helmet according to claim 1, comprising adjustment means of the neckband salient on the outside of the crown so as to adjust it to the user's head size.

11. The protection helmet according to claim 10, wherein the adjustment means comprise at least one flexible strap.

12. The protection helmet according to claim 10, wherein the adjustment means comprise at least one strap and a device for performing lengthwise adjustment of said strap.

13. A method for storing at least two protection helmets according to claim 1, comprising the following steps:

placing the neckband of at least one of the protection helmets in the storage position, stacking at least one of the protection helmets on at least one of the other protection helmets.

* * * * *